US008412072B2

(12) United States Patent
Senda et al.

(10) Patent No.: US 8,412,072 B2
(45) Date of Patent: Apr. 2, 2013

(54) FIXING DEVICE AND IMAGE-FORMING APPARATUS

(75) Inventors: Seiichi Senda, Nagoya (JP); Makoto Souda, Nagoya (JP); Tomitake Aratachi, Nagoya (JP); Kiyoshi Sugimoto, Kuwana (JP)

(73) Assignee: Brother Kogyo Kabushiki Kaisha, Nagoya-shi, Aichi (JP)

( * ) Notice: Subject to any disclaimer, the term of this patent is extended or adjusted under 35 U.S.C. 154(b) by 0 days.

(21) Appl. No.: 13/596,813

(22) Filed: Aug. 28, 2012

(65) Prior Publication Data

US 2012/0321361 A1 Dec. 20, 2012

Related U.S. Application Data

(62) Division of application No. 11/861,546, filed on Sep. 26, 2007, now abandoned.

(30) Foreign Application Priority Data

Sep. 28, 2006 (JP) ..... 2006-264301
Sep. 28, 2006 (JP) ..... 2006-264402
Sep. 28, 2006 (JP) ..... 2006-264537

(51) Int. Cl.
*G03G 15/16* (2006.01)

(52) U.S. Cl. ..... 399/122; 399/328

(58) Field of Classification Search ..... 399/122, 399/320, 328, 330, 331
See application file for complete search history.

(56) References Cited

U.S. PATENT DOCUMENTS 4,147,501 A * 4/1979 Goshima et al.
5,438,392 A 8/1995 Okada
5,539,509 A 7/1996 Tomoe et al.
5,579,098 A * 11/1996 Noguchi et al. ..... 399/122
5,581,340 A 12/1996 Hayashi et al.
5,708,927 A * 1/1998 Etoh ..... 399/122
5,854,465 A 12/1998 Kishi et al.
6,253,046 B1 * 6/2001 Horrall et al.
6,505,027 B2 1/2003 Takeuchi et al.
2004/0234878 A1 11/2004 Miyazaki et al.
2005/0031386 A1 2/2005 Fujiwara et al.

(Continued)

FOREIGN PATENT DOCUMENTS

JP 55-164855 A 12/1980
JP 57-161877 A 10/1982

(Continued)

OTHER PUBLICATIONS

JP Office Action dtd Sep. 6, 2011, JP Appln. 2006-264537.

(Continued)

*Primary Examiner* — Walter L Lindsay, Jr.
*Assistant Examiner* — Milton Gonzalez
(74) *Attorney, Agent, or Firm* — Banner & Witcoff, Ltd.

(57) ABSTRACT

A fixing device for fixing a developed image of developer onto a recording sheet by heating and fusing the developer includes a heating roller, a pressure roller and a driving force input element. The heating roller is configured to be heated by a heat source, such as a halogen heater. The pressure roller is disposed adjacent to the heating roller, such that a recording sheet is fed and conveyed between the pressure roller and the heating roller. The driving force input element is fixed to the pressure roller for causing the pressure roller to rotate. A diameter Dp of the pressure roller and a nip width N between the heating roller and the pressure roller in circumferential directions thereof have a relationship represented by the following expression: $0.24<N/Dp<0.6$.

3 Claims, 9 Drawing Sheets

U.S. PATENT DOCUMENTS

| | | | | |
|---|---|---|---|---|
| 2008/0181686 | A1* | 7/2008 | Geyling et al. | |
| 2009/0232549 | A1* | 9/2009 | Foster et al. | 399/122 |

FOREIGN PATENT DOCUMENTS

| | | | |
|---|---|---|---|
| JP | 03-077968 | U | 8/1991 |
| JP | 04-316075 | A | 11/1992 |
| JP | 06-250550 | A | 9/1994 |
| JP | 06-308847 | A | 11/1994 |
| JP | 07-199716 | A | 8/1995 |
| JP | 08-044233 | A | 2/1996 |
| JP | 08-146800 | A | 6/1996 |
| JP | 08-166735 | A | 6/1996 |
| JP | 10-176710 | A | 6/1998 |
| JP | 2001-349324 | A | 12/2001 |
| JP | 2002-214949 | A | 7/2002 |
| JP | 2003-122178 | A | 4/2003 |
| JP | 2004-264482 | A | 9/2004 |
| JP | 2005-189389 | A | 7/2005 |

OTHER PUBLICATIONS

JP Office Action dtd Oct. 11, 2011, JP Appln. 2006-264301.

* cited by examiner

FIG. 2A
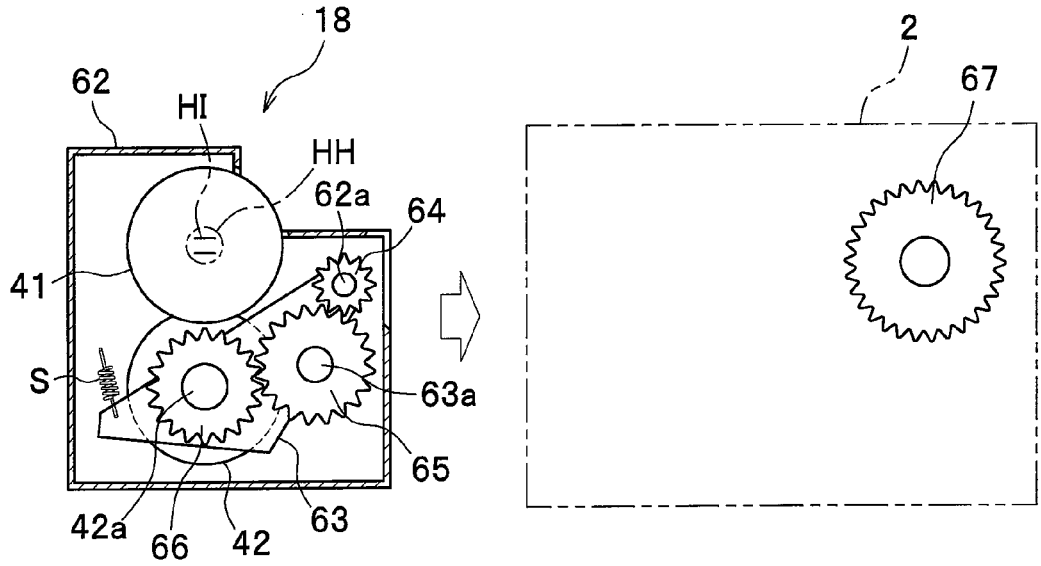
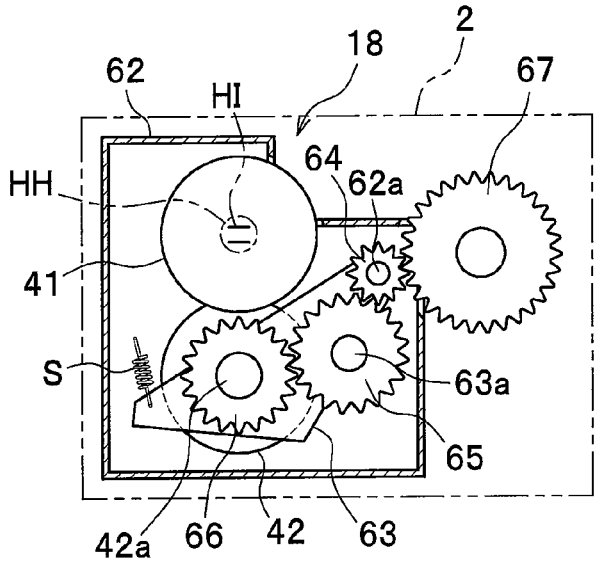
FIG. 2B
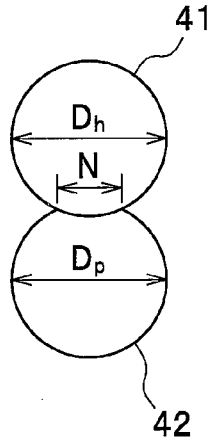
FIG. 2C

FIG. 3A
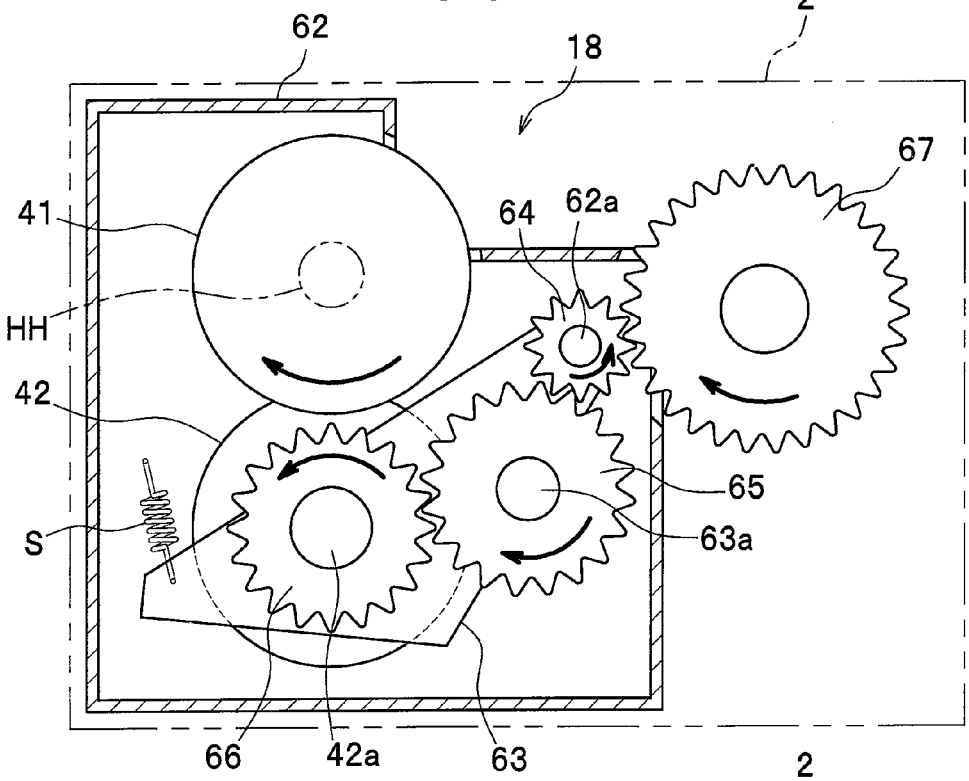
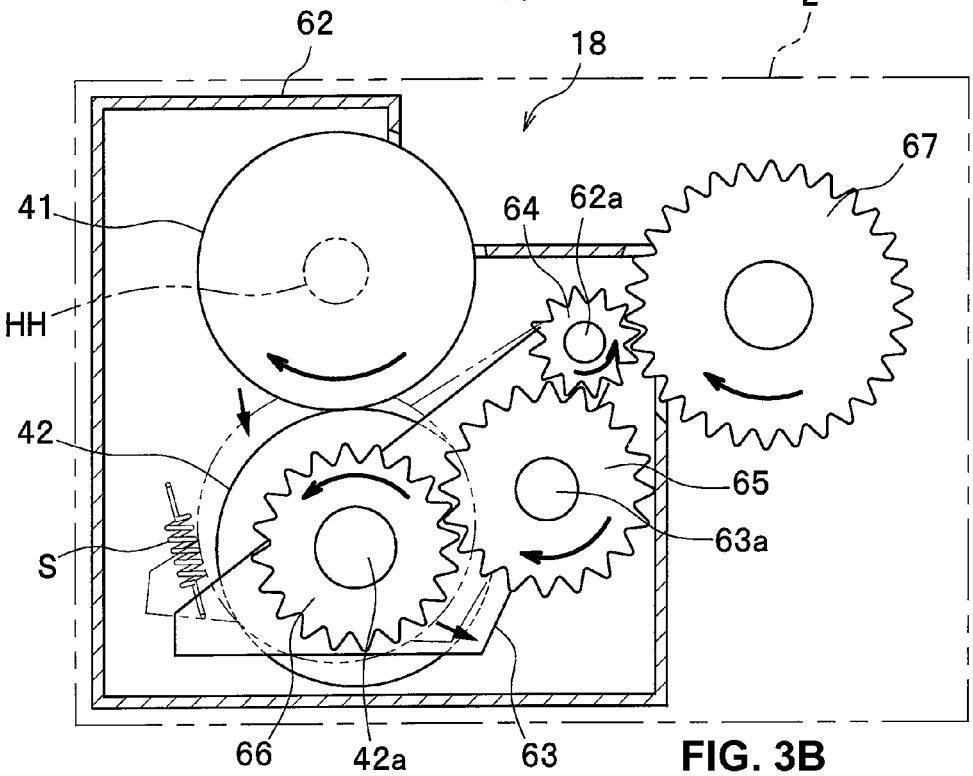
FIG. 3B

FIG. 4A
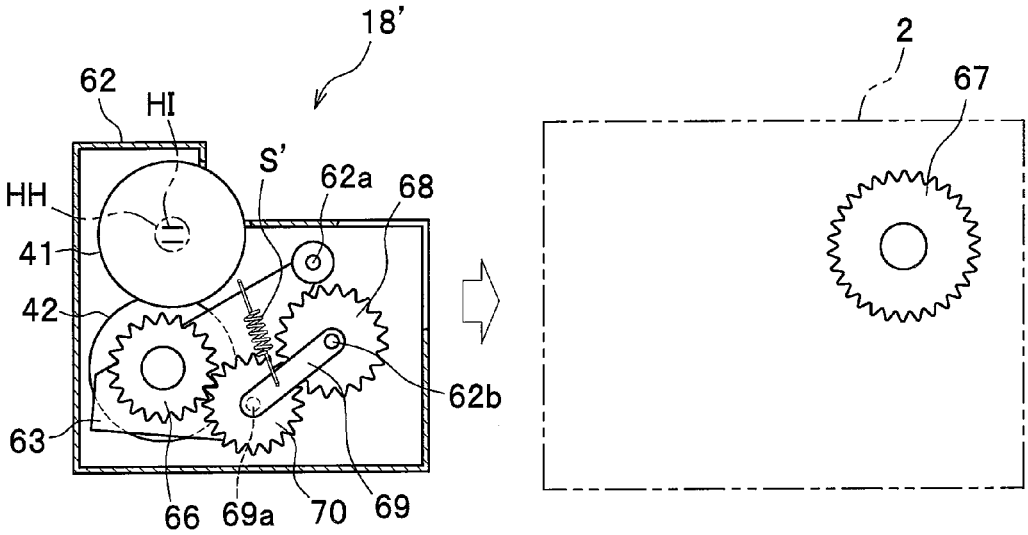
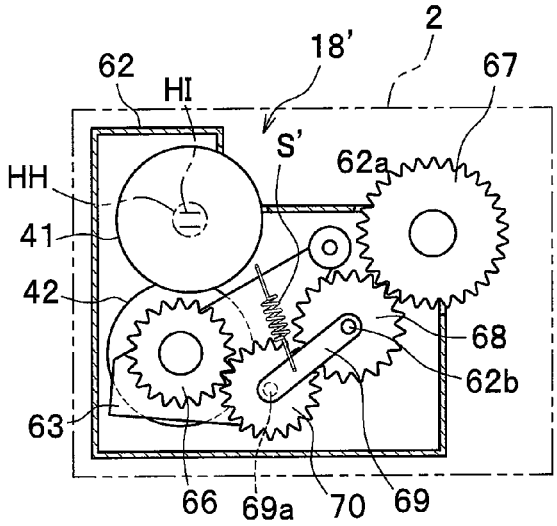
FIG. 4B

FIG. 5A
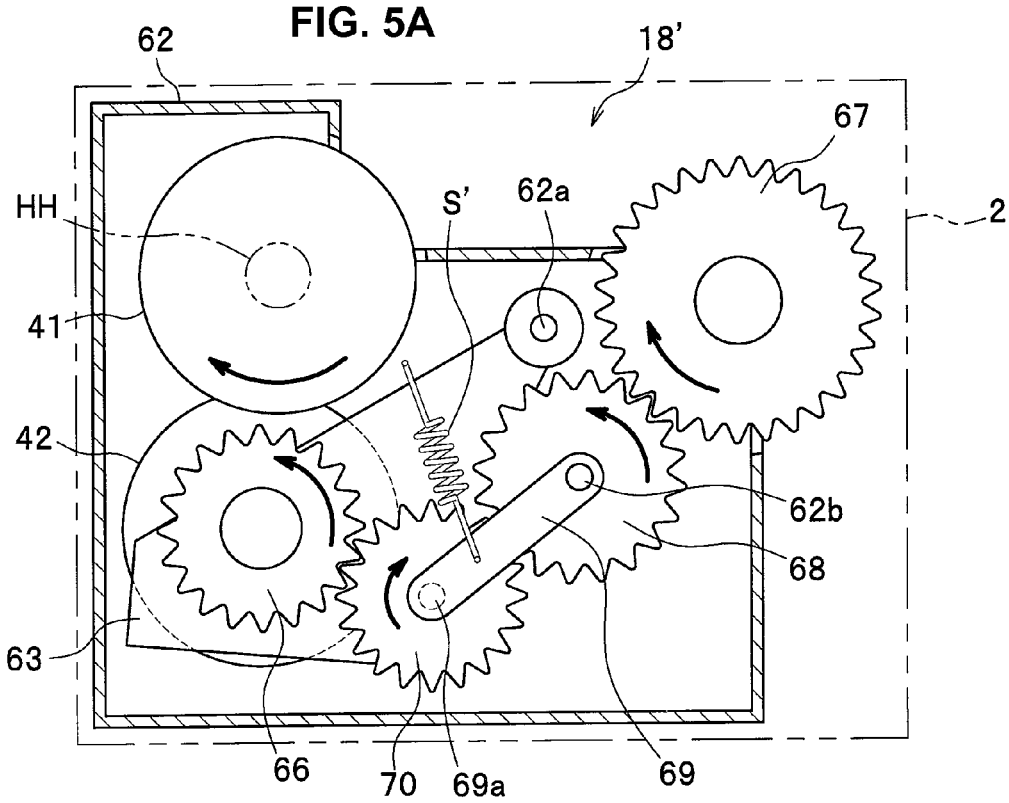
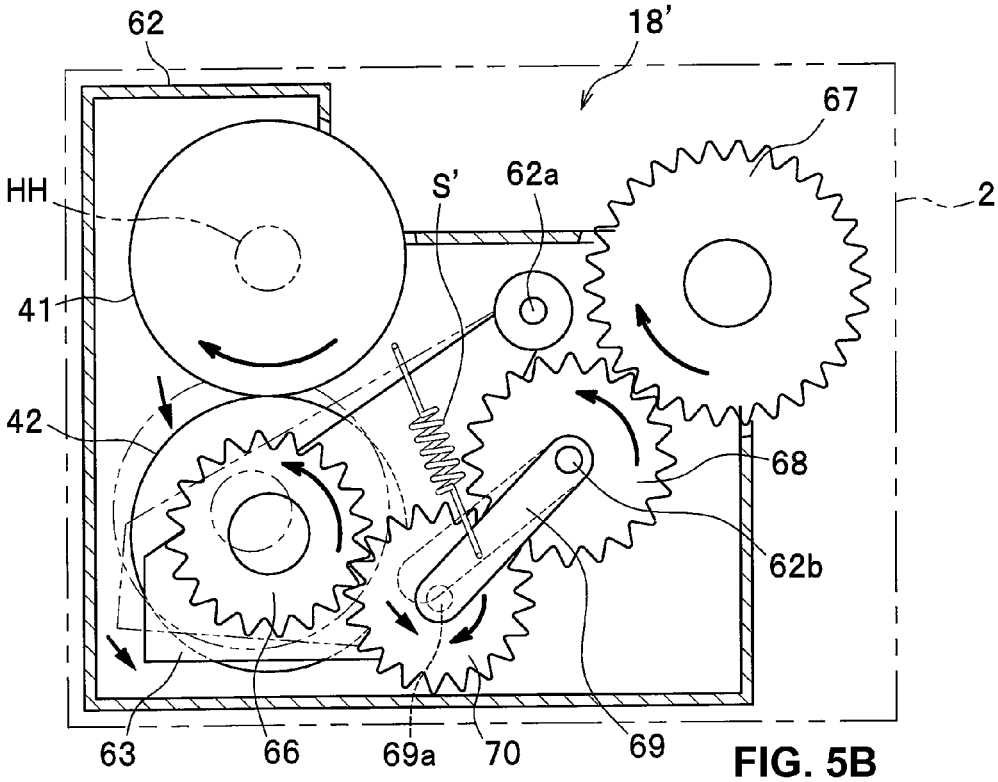
FIG. 5B

FIXING DEVICE AND IMAGE-FORMING APPARATUS

CROSS-REFERENCE TO RELATED APPLICATION(S)

This application is a divisional application of prior U.S. application Ser. No. 11/861,546, filed Sep. 26, 2007, which claims the foreign priority benefit under Title 35, United States Code, §119 (a)-(d), of Japanese Patent Application Nos. 2006-264301, 2006-264402 and 2006-264537, each filed Sep. 28, 2006 in the Japan Patent Office, the disclosure of which is herein incorporated by reference in its entirety.

BACKGROUND OF THE INVENTION

1. Field of the Invention

The present invention relates to a fixing device for fixing a developed image of toner by heating and fusing the toner onto a sheet of paper or the like (recording sheet), and an image-forming apparatus having such a fixing device.

2. Description of Related Art

In general, the image-forming apparatus, such as a laser printer, includes a fixing device for fixing a developed image of toner, which has been transferred from a photoconductor to a sheet, on the sheet by heating and fusing the toner. The fixing device of a type known in the art, as disclosed in JP 6-308847 A for example, includes a heating roller configured to rotate on an axis fixed to a body of the fixing device, a driving force input element typically disposed at an end of the heating roller (and fixed coaxially to the heating roller and configured to rotate together with the heating roller), and a pressure roller configured to be pressed against the heating roller and to become deformed elastically when pressed against the heating roller.

In this type of the fixing device, typically, a driving force supplied from a driving source installed in the image-forming apparatus is transmitted by a plurality of gears to the driving force input element fixed to the heating roller, which causes the heating roller to rotate, and the pressure roller pressed against the heating roller is caused to rotate according as the heating roller rotates.

It has turned out desirable in recent years to be able to increase a nip width between the pressure roller and the heating roller (contact width) in the circumferential direction of the rollers (perpendicular to the axes), so as to increase a time of contact or an area of contact between the heating roller and the sheet, thereby making the heating roller operable at lower temperatures and/or at higher speeds. In the 'heating roller driving' type fixing device as described above, however, if the nip width were increased too much, the heating roller would possibly slip on the sheet along the deformed face of the pressure roller.

To be more specific, assuming that the pressing force of the pressure roller to the heating roller were increased or the contact surface of the pressure roller were made of a softer material in order to make the nip width greater, a portion of the pressure roller opposed to the heating roller would become recessed significantly when the pressure roller is pressed against the heating roller. Such a deformed (recessed) shape of the pressure roller (with its roundness impaired) however would possibly make its feeding resistance (or a resisting force exerted by the pressure roller on a sheet being fed forward) greater than a feeding force exerted by the heating roller on the sheet, and thus would disadvantageously cause a slip to occur between the heating roller and the sheet.

The inventors named in the present application, in an attempt to eliminate the above disadvantages, have discovered that the slip of a sheet as described above can be suppressed with the help of a particular arrangement ('pressure roller driving' scheme) where a driving force from the driving source is transmitted to a pressure roller, instead of a heating roller, to cause the pressure roller to rotate and the heating roller is in turn caused to rotate according as the pressure roller rotates.

This 'pressure roller driving' arrangement where the rotating pressure roller causes the heating roller to rotate typically includes: a heating roller incorporating a heat source that is fixed so as to rotate together with the heating roller; a pressure roller disposed in parallel with the heating roller; a pressing spring configured to press the heating roller against the pressure roller; and a driving force input element disposed at an end of the pressure roller (and fixed coaxially to the pressure roller and configured to rotate together with the pressure roller).

In a fixing device having an arrangement as described above, a driving force from a driving source disposed in an image-forming apparatus is transmitted by a plurality of gears to the driving force input element for the pressure roller, so that the pressure roller supplied with the driving force is caused to rotate while the heating roller is caused (driven) to rotate following the rotation of the pressure roller. The heating roller is configured to reciprocate toward and away from the pressure roller, in order to absorb the variations in an outside diameter.

In the 'pressure roller driving' scheme, however, it was unclear how much the nip width should be increased to make the heating roller practicably operable at lower temperatures. Moreover, since the 'pressure roller driving' scheme would inevitably cause the heat source to vibrate (reciprocate) together with the heating roller, it has been believed that the 'heating roller driving' scheme should be preferable to prevent damage to the heat source.

With this in view, it is appreciated that a problem in need of solution is to provide a fixing device and an image-forming apparatus with a heating roller operable at lower temperatures, which could be realized ideally by increasing a nip width but believed to be impossible due to a slip that would occur in the 'heating roller driving' scheme.

Illustrative, non-limiting embodiments of the present invention overcome the above disadvantages and other disadvantages not described above. Also, the present invention is not required to overcome the disadvantages described above, and an illustrative, non-limiting embodiment of the present invention may not overcome any of the problems described above.

SUMMARY OF THE INVENTION

In one aspect of the present invention, a fixing device for fixing a developed image onto a recording sheet is provided. The fixing device comprises a heating roller, a pressure roller, and a driving force input element. The heating roller is configured to be heated by a heat source. The pressure roller is disposed adjacent to the heating roller such that the recording sheet is fed and conveyed between the pressure roller and the heating roller. The driving force input element is fixed to the pressure roller for causing the pressure roller to rotate. A diameter Dp of the pressure roller and a nip width N between the heating roller and the pressure roller in circumferential directions thereof are configured to have a relationship represented by the following expression:

$$0.24<N/Dp<0.6.$$

With this construction, in which the fixing device implemented in the 'pressure roller driving' scheme has the pressure roller diameter Dp and the nip width N determined so as to satisfy the relationship of: $0.24<N/Dp<0.6$, the nip width N can be rendered greater in no danger of causing a slip, thus the heating roller (fixing device) can be made operable at lower temperatures. It has been shown experimentally by the inventors named in the present application that if the above relationship between the pressure roller diameter Dp and the nip width N ($0.24<N/Dp<0.6$) were applied to the 'heating roller driving' arrangement, a slip would probably occur. Accordingly, the aforementioned construction consistent with the present invention can achieve as low an operation temperature of the heating roller as could not be realized due to a strong likelihood of a slip in the 'heating roller driving' scheme. The fixing device as described above may be provided in an image-forming apparatus having a photoconductor and a developer unit.

Some exemplary embodiments of the present invention may be able to achieve an increase in nip width which would be considered to be impossible in view of a strong likelihood of a slip in the 'heating roller driving' scheme, and thus can provide a fixing device with a heating roller operable at lower temperatures.

BRIEF DESCRIPTION OF THE DRAWINGS

The above aspects, other advantages and further features of the present invention will become more apparent by describing in detail illustrative, non-limiting embodiments thereof with reference to the accompanying drawings, in which:

FIG. 2A is a side view of a fixing device of FIG. 1, as illustrated before it is installed in the laser printer;

FIG. 2B is a side view of the fixing device of FIG. 1, as illustrated after it is installed in the laser printer;

FIG. 2C is a side view of a pressure roller and a heating roller in the fixing device of FIG. 1, as schematically illustrated for explaining a relationship among the diameters of the pressure roller and the heating roller and a nip width;

FIG. 3A is a side view of the fixing device according to the first embodiment, in which the pressure roller is pressed against the heating roller with a predetermined nip width measured between the rollers;

FIG. 3B is a side view of the fixing device according to the first embodiment, in which a pressure arm has swung down;

FIG. 4A is a side view of a fixing device according to a second exemplary embodiment, as illustrated before it is installed in a laser printer;

FIG. 4B is a side view of the fixing device of FIG. 4A, as illustrated after it is installed in the laser printer;

FIG. 5A is a side view of the fixing device according to the second embodiment, in which a pressure roller is pressed against a heating roller with a predetermined nip width measured between the rollers;

FIG. 5B is a side view of the fixing device according to the second embodiment, in which a pressure arm has swung down;

DETAILED DESCRIPTION OF THE EXEMPLARY EMBODIMENTS

First Embodiment

General Setup of Laser Printer

Figure 1:
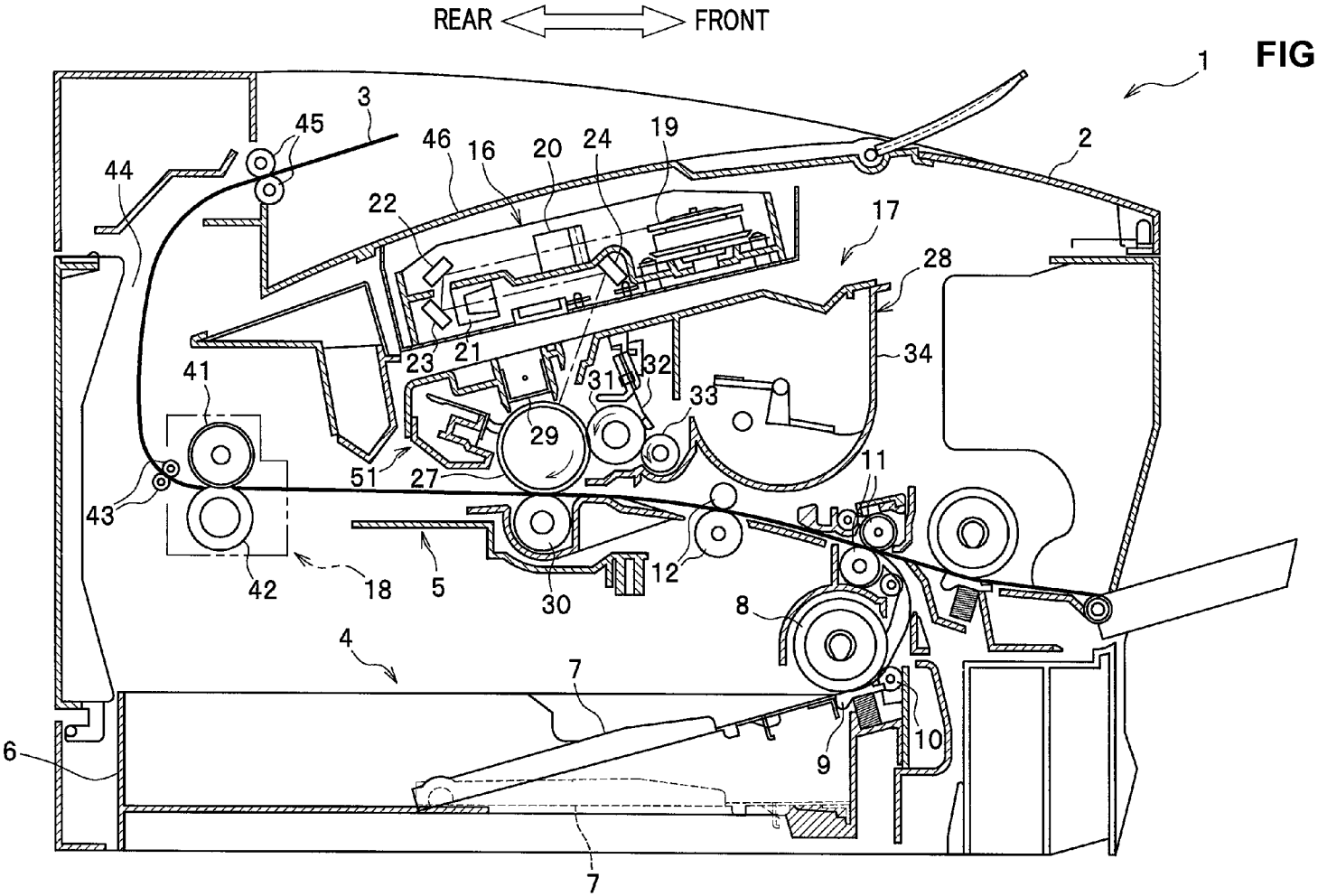
FIG. 1 is a vertical section of a laser printer as an example of an image-forming apparatus according to a first exemplary embodiment of the present invention.

At the outset, a brief description will be given of a general setup of a laser printer as an example of an image-forming apparatus according to a first embodiment of the present invention. In the drawings, to which reference will be made, FIG. 1 is a vertical section of a laser printer as an example of the image-forming apparatus according to the first embodiment.

As shown in FIG. 1, the laser printer 1 includes a feeder unit 4 for feeding a sheet 3 into a body casing 2, an image-forming unit 5 for forming an image on a sheet 3 fed by the feeder unit 4, and a number of other components.

Feeder Unit Setup

The feeder unit 4 includes a sheet feed tray 6 and a sheet pressure plate 7. The sheet feed tray 6 is removably installed in a bottom space provided in the body casing 2. The sheet pressure plate 7 is provided in the sheet feed tray 6. The feeder unit 4 also includes a sheet feed roller 8, a sheet feed pad 9, and a paper powder remover rollers 10, 11. The sheet feed roller 8 and the sheet feed pad 9 are provided above an edge of one side of the sheet feed tray 6. The paper powder remover rollers 10, 11 are provided along a route of conveyance of the sheet 3 downstream relative to the sheet feed roller 8 in a direction of the conveyance of the sheet 3. The feeder unit 4 further includes a resist roller 12 located 'downstream' relative to the paper powder remover rollers 10, 11. Hereupon, and in the following description as well, the term 'downstream' or 'upstream' is and will be used alone to represent a relative position along the route of conveyance of the sheet 3, downstream or upstream with respect to the direction of conveyance of the sheet 3.

The feeder unit 4 constructed as described above is configured to bring one sides of sheets 3 in the sheet feed tray 6 close to the sheet feed roller 8 by means of the sheet pressure plate 7, feed the sheets 3 one after another by means of the sheet feed roller 8 and the sheet feed pad 9 to pass each sheet 3 through rollers 10, 11 and 12 to the image-forming unit 5 on a one-by-one basis.

Image-Forming Unit Setup

The image-forming unit 5 includes a scanner unit 16, a process cartridge 17, a fixing device 18, and other components.

Scanner Unit Setup

The scanner unit 16 is disposed in an upper space provided in the body casing 2. The scanner unit 16 includes a laser beam emitter (not shown), a polygon mirror 19 configured to be driven to spin, lenses 20, 21, reflecting mirrors 22, 23, 24, and other components. A laser beam formed in accordance with image data and emitted from the laser beam emitter is transmitted or reflected by the polygon mirror 19, lens 20, reflecting mirrors 22, 23, lens 21, and reflecting mirror 24 in this sequence as indicated by a chain line, so as to scan a surface of the photoconductor drum 27 in the process cartridge 17 at high speed.

Process Cartridge Setup

The process cartridge 17 is disposed below the scanner unit 16, and detachably installed in the body casing 2. A hollow housing 51 making up the outer frame of the process cartridge 17 accommodates a developer cartridge 28, a photoconductor drum 27, a scorotron charger 29, a transfer roller 30, and other components.

The developer cartridge 28 is detachably attached to the housing 51, and includes a development roller 31, a doctor blade 32, a supply roller 33 and a toner hopper 34. Toner in the toner hopper 34 is supplied to the development roller 31 by the action of the supply roller 33 rotating in a direction indicated by arrow (counterclockwise), and at the same time becomes positively charged by friction between the supply roller 33 and the development roller 31. The toner supplied onto the development roller 31 goes between the doctor blade 32 and the development roller 31 as the development roller 31 rotates in a direction indicated by arrow (counterclockwise), to form a thin film in a predetermined thickness, so that the film of toner is retained on the development roller 31.

The photoconductor drum 27 is supported by the housing 51 in such a manner that the photoconductor drum 27 is rotatable in a direction indicated by arrow (clockwise). The photoconductor drum 27 has its drum body grounded, while a positively charged photoconductive layer forms a cylindrical surface of the drum body.

The scorotron charger 29 is disposed over the photoconductor drum 27 and opposed to the photoconductive surface of the photoconductor drum 27 with a gap left between the photoconductor drum 27 and the scorotron charger 29 so as to keep the scorotron charger 29 from contact with the photoconductor drum 27. The scorotron charger 29 may be a known charger of scorotron type having a charging wire made of tungsten or the like for generating corona discharge and configured to positively charge the surface of the photoconductor drum 27 uniformly.

The transfer roller 30 is disposed under the photoconductor drum 27 and opposed to the photoconductive surface of the photoconductor drum 27, so as to have contact with the photoconductive surface of the photoconductor drum 27. The transfer roller 30 is supported by the housing 51 in such a manner that the transfer roller 30 is rotatable counterclockwise. The transfer roller 30 has a metal roller shaft covered with a conductive rubber material. In the transfer process, a transfer bias is applied to the transfer roller 30.

In operation, the photoconductive surface of the photoconductor drum 27 is positively charged uniformly by the scorotron charger 29, and then exposed to a rapidly scanning laser beam from the scanner unit 16. This exposure process lowers the potential of an exposed area(s) on the photoconductive surface, thus forming an electrostatic latent image based upon the image data. Hereupon, "electrostatic latent image" is an invisible image produced on the uniformly positively charged surface of the photoconductor drum 27 with the exposed areas made lower in potential by exposure to the laser beam. Next, as the development roller 31 rotates, toner particles carried on the development roller 31 come in contact with the opposed photoconductor drum 27; then the toner particles are supplied onto the surface of the photoconductor drum 27, and transferred to the areas corresponding to the electrostatic latent image formed thereon. The toner particles are retained selectively, i.e., solely in the areas corresponding to the electrostatic latent image, and thus visualize the latent image, to form a toner image. The process described above is called reversal process.

Thereafter, as the photoconductor drum 27 and the transfer roller 30 rotate so that the sheet 3 is held and fed forward between the rollers 27 and 30, the toner image formed on the surface of the photoconductor drum 27 is transferred to the sheet 3 while the sheet 3 is conveyed between the photoconductor drum 27 and the transfer roller 30.

Fixing Device Setup

The fixing device 18, which is disposed downstream relative to the process cartridge 17, includes a heating roller 41, a pressure roller 42 configured to be pressed against the heating roller 41, and a pair of conveyor rollers 43 disposed downstream relative to the heating roller 41 and the pressure roller 42. In the fixing device 18 constructed as described above, the toner image transferred onto the sheet 3 is fixed by heating and fusing the toner while the sheet 3 goes between the heating roller 41 and the pressure roller 42. Thereafter, the sheet 3 is conveyed by the conveyor rollers 43 to a sheet output path 44. The sheet 3 forwarded to the sheet output path 44 is then discharged by sheet output rollers 45 onto a sheet output tray 46.

Detailed Structure of Fixing Device

A detailed structure of the fixing device according to exemplary embodiments of the present invention will be described hereafter. In the drawings to which reference will be made, FIG. 2A is a side view of the fixing device of FIG. 1 to show the state before it is installed in the laser printer; FIG. 2B is a side view of the fixing device to show the state after it is installed in the laser printer; and FIG. 2C is a side view of a pressure roller and a heating roller in the fixing device of FIG. 1, as schematically illustrated for explaining a relationship among the diameters of the pressure roller and the heating roller and a nip width.

As shown in FIG. 2A, the fixing device 18 includes a frame 62, a pressure arm 63, an input gear 64, an intermediate gear 65 and a driving force input element 66, in addition to its principal components (i.e., heating roller 41 and pressure roller 42) described above. The fixing device 18 is installed near an output gear 67 rotatably provided in the body casing 2 of the laser printer 1. A driving force from a driving source (not shown) provided in an appropriate place in the body casing 2 is transmitted to the output gear 67 by a plurality of gears.

Figure 6A:
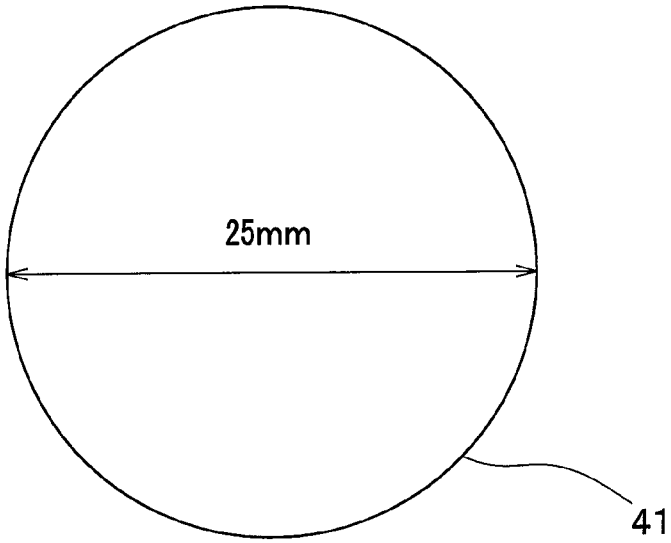
FIG. 6A is a side view showing an example of the heating roller.

The heating roller 41 is a cylindrical member having a hollow in which a halogen heater HH is installed, so that the heating roller 41 can be heated by the halogen heater HH. The heating roller 41 is rotatably supported at each end thereof by a bearing unit (not shown) fixed to the frame 62. The halogen heater HH has two ends fixed to the frame 62. The heating roller 41 may be of 25 mm in diameter as shown in FIG. 6A, for example. The heating roller 41 may be made of aluminum, and/or may have a surface coated with Teflon (registered trademark, polytetrafluoroethylene or PTFE).

The pressure roller 42 is a cylindrical member having a rotation shaft 42*a* of which two end portions projecting outwardly along its rotation axis from both ends of the pressure roller 42, respectively, are supported by bearing units (not shown) fixed to the pressure arm 63; thus the pressure roller 42 is rotatable on its rotation axis (rotation shaft 42*a*) relative to the pressure arm 63. The driving force input element 66 is fixed to a tip end of one of the end portions of the rotation shaft 42*a* passing through and projecting from the pressure arm 63.

Figure 6B:
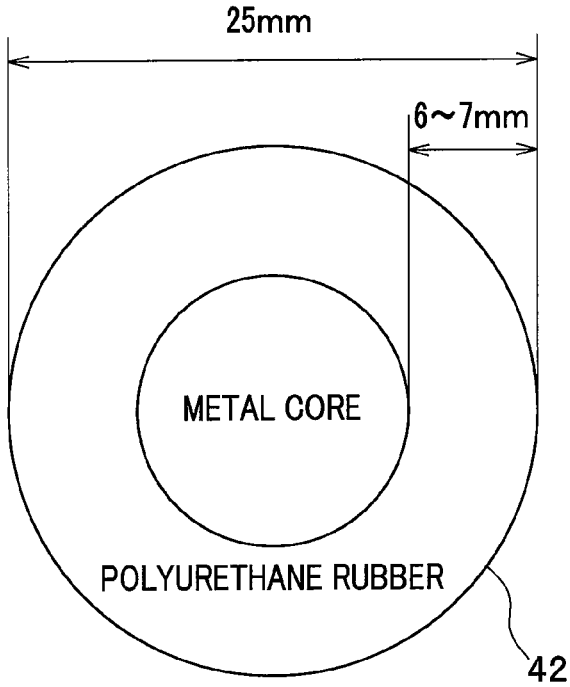
FIG. 6B is a side view showing an example of the pressure roller.

The pressure roller 42 may be of 25 mm in diameter, for example, as shown in FIG. 6B. The pressure roller 42 may have a bar-like metal core provided in the center, a polyurethane rubber layer of 6-7 mm in thickness provided around a cylindrical surface the core, and a tube made of Teflon (registered trademark, PTFE) of 20-50 μm in thickness fitted on an outer surface of the polyurethane rubber layer. The polyurethane rubber layer makes the pressure roller 42 resiliently deformable. The polyurethane material used therefor may be foamed to make the layer more easily deformable, so that a nip width can be made greater.

A diameter Dp of the pressure roller 42 and a nip width (contact width) N between the heating roller 41 and the pressure roller 42 in circumferential directions thereof, as shown in FIG. 2C, are configured to have a relationship represented by the following expression (1):

$$0.24<N/Dp<0.6 \quad (1)$$

where the nip width N is a length of a curve formed on a plane perpendicular to the rotation axis of the pressure roller 42 along the surface of a recessed portion of the pressure roller 42 which is produced when the pressure roller 42 is pressed against the heating roller 41 (or a length of an arc formed on a plane perpendicular to the rotation axis of the heating roller 41 along a surface in contact with the recessed portion of the pressure roller 42).

The nip width N may be measured, for example, by a method of utilizing a sheet of paper one side of which is solidly painted in black all over its surface (such a sheet will hereinafter referred to as "black sheet"), as follows. Specifically, in this method, a black sheet is held between the heating roller 41 and the pressure roller 42 for a predetermined period of time, and then removed therefrom for observation. An area (strip) of the black sheet held by the two rollers 41, 42 (extending in a direction perpendicular to the direction of conveyance) should become glossier than the other areas. The width of the glossier strip (length from end to end in the direction of conveyance of the sheet) is measured by vernier calipers, or the like, to thereby measure the nip width N.

The diameter Dp of the pressure roller 42 and a diameter Dh of the heating roller 41 are configured to have a relationship represented by the following expression (2):

$$Dp/2<Dh<2Dp \quad (2)$$

The pressure arm 63 is comprised of a pair of oblong members blanked out from sheet metal, which are disposed symmetrically at the opposite ends of the pressure roller 42, each extending in the direction perpendicular to the rotation axis of the pressure roller 42, as shown in FIG. 2A. Each of the oblong members of the pressure arm 63 has a first point located near one end thereof, and a second point located at an appropriate position that is closer to the other end thereof than the first point and separate from the first point at a predetermined distance. The two oblong members of the pressure arm 63 are fixed relative to each other by a support shaft 62*a* (first axis) which supports the first points of the oblong members, and by a rotation shaft 42*a* (second axis) which supports the second points of the oblong members. The pressure arm 63 is swingably supported at the first points by the support shaft 62*a* fixed to the frame 62 in a manner that permits the pressure arm 63 to swing on the first axis (coincident with the support shaft 62*a*) in its entirety. The pressure arm 63 is configured to support the pressure roller 42, with the rotation shaft 42*a* supported at the second points of the oblong members of the pressure arm 63, in a manner that permits the pressure roller 42 to rotate on the rotation shaft 42*a* (coincident with the second axis of the pressure arm 63). An extension spring S is attached to an appropriate position in each of the oblong members of the pressure arm 63, which position is a predetermined distance farther than each of the second points of the oblong members of the pressure arm 63 from each of the first points of the oblong members of the pressure arm 63.

One end of the extension spring S is attached to the pressure arm 63, and the other end of the extension spring S is attached to the frame 62. The positions of attachment of the extension spring S in the pressure arm 63 and the frame 62 are appropriately determined so that the extension spring S biases the pressure arm 63 toward the heating roller 41, and the pressure roller 42 attached to the pressure arm 63 thus biased is also biased and pressed against the heating roller 41.

The input gear 64 is, as shown in FIG. 2B, so located in the fixing device 18 as to mesh with an output gear 67 provided in the body casing 2 when the fixing device 18 is installed in the body casing 2. The input gear 64 is rotatably supported by the support shaft 62*a* provided in the frame 62, so as to rotate on an axis coincident with the axis (first axis) on which the pressure arm 63 is swingable. In other words, the input gear 64 has its rotation axis fixed relative to the frame 62. Therefore, once the fixing device 18 is installed in the body casing 2, the input gear 64 therein and the output gear 67 in the body casing 2 are kept in constant mesh.

The intermediate gear 65 is in mesh with the input gear 64 and the driving force input element 66, and rotatably supported by the support shaft 63*a* provided in the pressure arm 63. Accordingly, the intermediate gear 65 is swingable around the support shaft 62*a* according as the pressure arm 63 swings, and is moved around the input gear 64.

The driving force input element 66 is located at an end of the pressure roller 42 and fixed coaxially to the pressure roller 42. Thus, the driving force input element 66 is rotatable together with the pressure roller 42 on an axis coincident with the second axis of the pressure roller 42 (rotation shaft 42*a*) on which the pressure roller 42 is rotatable. Therefore, the driving force input element 66 is swingable around the support shaft 62*a* according as the pressure arm 63 swings. The driving force input element 66 is connected with the input gear 64 by the intermediate gear 65, and thus a driving force from the output gear 67 in the body casing 2 is transmitted through the input gear 64 and the intermediate gear 65 to the driving force input element 66.

The next discussion will focus on the relative positions of the gears 67, 64-66 during transmission of the driving force from the output gear 67 to the driving force input element 66, to explain how the swinging motion of the pressure arm 63 affects the meshing conditions between the adjacent gears, with reference to FIGS. 3A and 3B. In the drawings to which reference will be made, FIG. 3A illustrates in side elevation a particular condition of the fixing device in which the pressure roller is pressed against a heating roller with a predetermined nip width measured between the rollers, and FIG. 3B illustrates in side elevation a particular condition of the fixing device in which the pressure arm has swung down. To illustrate the swinging motion of the pressure arm 63 with some exaggeration, FIG. 3A shows a state in which the pressure roller 42 yields to the contact pressure and becomes deformed to a predetermined extent, and FIG. 3B shows a state in which the pressure roller 42 is very little deformed, though it is to be understood that the pressure roller 42 in practical operation should become deformed nearly to a predetermined extent because the swinging motion of the pressure arm 63 is very small in actuality.

As shown in FIG. 3A, in normal operation, the pressure roller 42 is pressed against the heating roller 41 so as to achieve a predetermined range of nip width N, and adjacent ones of the gears 67, 64-66 are in mesh with each other. The driving force transmitted from a driving source (not shown) through a plurality of gears to the output gear 67 is transmitted through the input gear 64, the intermediate gear 65 and the driving force input element 66, to the pressure roller 42. The rotation of the pressure roller 42 causes the heating roller 41 to rotate, and a developed image of toner, which has been transferred to a sheet 3, is fixed well on the sheet 3, while the sheet 3 is being conveyed through between the two rollers 41, 42.

It is to be noted that the pressure roller 42 is formed with soft rubber provided at its outermost layer and thus with precision in its external-diameter dimension (i.e., its roundness in cross section) lower than that of the heating roller 41. Therefore, in the normal operation as mentioned above, the pressure arm 63 may shift (swing) downwardly as shown in FIG. 3B, due to insufficient roundness (imprecisely shaped surface) of the pressure roller 42. Even if this is the case, the position of the input gear 64 would never shift relative to the fixing device 18, and thus relative to the body casing 2; accordingly, the input gear 64 would never come off the output gear 67 out of mesh.

Furthermore, the relative positions of the input gear 64, intermediate gear 65 and driving force input element 66 would not change relative to the pressure arm 63, and thus the input gear 64, intermediate gear 65 and driving force input element 66 would never come out of mesh. Consequently, even when the pressure arm 63 swings downwardly, the driving force from the output gear 67 is transmitted through the input gear 64, intermediate gear 65 and driving force input element 66, to the pressure roller 42 without fail.

Assuming that the pressure roller 42 were rotatably supported by the frame 62 so that the rotation axis of the pressure roller 42 is fixed relative to the frame 62 (i.e., relative to the rotation axis of the heating roller 41), the possible variations in external diameter of the pressure roller 42 due to its low dimensional precision would not be able to be accommodated, and cause the contact area (nip width) between the heating roller 41 and the pressure roller 42 to vary. Resultantly, a feeding force applied to the sheet between the heating roller 41 and the pressure roller 42 would vary, which would possibly form wrinkles in the sheet.

In contrast, according to the present embodiment, the pressure arm 63 swingable up and down is provided, so that the pressure roller 42 is moved toward and away from the heating roller 41, and thus the variations of the feeding force as mentioned above can be suppressed. As a result, wrinkles which would be formed in the sheet can be prevented.

With this embodiment, the following advantageous effects can be exerted.

Since N/Dp is greater than 0.24, the nip width N can be made so great as could be achieved to the limit placed by the size (diameter) of the pressure roller 42. Accordingly, the time and area of contact between the sheet 3 and the heating roller 41 when the sheet 3 passes between the two rollers 41 and 42 can be increased, so that the heating roller 41 can be rendered operable at lower temperatures and/or at higher speeds. Moreover, since $N/Dp<0.6$, the excessive increase in the nip width which would increase the driving torque of the pressure roller 42 can be suppressed, and thus the overload on the fixing device can be avoided. This feature of $N/Dp<0.6$ in this embodiment also serve to suppress excessive load on the sheet 3 passing between the pressure roller 42 and the heating roller 41.

Incidentally, the nip width N which satisfies the expression (1), if applied to a fixing device of 'heating roller driving' type (in which rotation of a heating roller causes a pressure roller to rotate), would cause the heating roller to slip on the sheet being conveyed by the pressure roller. Therefore, the nip width N which satisfies the expression (1) may be deemed effective particularly in the 'pressure roller driving' arrangement as in the present embodiment. In other words, the present embodiment can realize a fixing device with a heating roller operable at lower temperatures and/or at higher speeds which would be impossible due to a likelihood of a slip in the 'heating roller driving' scheme.

Since the diameter Dp of the pressure roller 42 and the diameter Dh of the heating roller 41 have a relationship represented by the expression (2): $Dp/2<Dh<2Dp$, the nip width N between the rollers 41 and 42 can be made as great as possible. Moreover, the dimensions of the rollers 41 and 42 are well balanced, and thus the space around the rollers 41, 42 can be utilized effectively.

Since the heating roller 41 is configured not to reciprocate, the entry point of the sheet 3 can be determined in a fixed position, and thus the image quality can be improved. Since the heating roller 41 is configured not to reciprocate, the load which would otherwise be imposed on the halogen heater HH can be suppressed, and thus damage to electric system (electric terminal HI) fixed to the frame of the halogen heater HH can be prevented.

Regardless of the swinging motion of the pressure arm 63, the relative positions of the output gear 67 and the input gear 64 (distance between the axes thereof), and the relative positions of the input gear 64, the intermediate gear 65 and the driving force input element 66 (distances between the axes of adjacent gears) can be maintained constant at all times. Therefore, the gears 67, 64-66 are kept in constant mesh, and thus good transmission of the driving force to the pressure roller 42 can be ensured.

The present invention is not limited to the first embodiment described above, but can rather be implemented in various alternative forms, as will be demonstrated below.

Although only one intermediate gear 65 is provided in the first embodiment, the number of the intermediate gears applicable to the present invention is not limited to one; rather, more than one intermediate gear may be provided as the case may be. In an alternative embodiment, the input gear 64 and the driving force input element 66 may be adapted to mesh together directly.

In the first embodiment, an extension spring S configured to bias the pressure arm 63 toward the heating roller 41 so that the pressure roller 42 is biased and pressed against the heating roller 41 is adopted as a means for biasing the pressure roller 42 toward the heating roller 41, but the present invention is not limited thereto; for example, a compression spring or a torsion spring may be used, instead, or in combination.

Second Embodiment

Next, a second embodiment of the present invention will be described in detail with reference made to the drawings where appropriate. This embodiment has some commonalties with the first embodiment, and can be considered to provide a modification of the fixing device 18 of the first embodiment as described above. Therefore, the same components as in the first embodiment will be designated by the same reference numerals, and a duplicate description thereof will be omitted. In the drawings to which reference will be made, FIG. 4A is a side view of a fixing device according to the second embodiment to show the state before it is installed in a laser printer, and FIG. 4B is a side view of the fixing device of FIG. 4A to show the state after it is installed in the laser printer.

Besides components equivalent to those provided in the first embodiment, such as pressure arm 63, driving force input element 66, etc., a fixing device 18' according to the second embodiment includes, as shown in FIG. 4A, additional components that are not provided in the first embodiment, which include an input gear 68, a swingable arm 69 and a planet gear 70.

The input gear 68 is rotatably supported by a support shaft 62*b* provided in a position different from an axis (first axis) on which the pressure arm 63 is swingable. The input gear 68 is, as shown in FIG. 4B, so located in the fixing device 18' as to mesh with the output gear 67 provided in the body casing 2 when the fixing device 18' is installed in the body casing 2.

The swingable arm 69 is comprised of a pair of oblong members, which are disposed symmetrically at the opposite ends of the pressure roller 42, each extending in the direction perpendicular to the rotation axis of the pressure roller 42. Each of the oblong members of the swingable arm 69 has a first point located near one end thereof, and a second point located near the other end thereof. The two oblong members of the swingable arm 69 are fixed relative to each other by the support shaft 62*b* mentioned above which supports the firsts points of the oblong members, and by a support shaft 69*a* which supports the second points of the oblong members. The swingable arm 69 is swingably supported at the first points by the support shaft 62*b* provided in the frame 62 in a manner that permits the swingable arm 69 to swing on its rotation axis (coincident with the support shaft 62*b*; thus coaxial with the rotation axis of the input gear 68) in its entirety. An extension spring S' is attached to an appropriate position between first and second points of each oblong member of the swingable arm 69. While one end of the extension spring S' is attached to the swingable arm 69, the other end thereof is attached to the frame 62.

The planet gear 70 is rotatably supported by the support shaft 69*a* of the swingable arm 69. The planet gear 70 is configured to mesh with the input gear 68 once the illustrated components (at the least, input gear 68, swingable arm 69, support shafts 62*b*, 69*a*, and planet gear 70) are assembled together into the fixing device 18'. The extension spring S' is configured to bias the second point of the swingable arm 69 toward the pressure roller 42, to thereby cause the planet gear 70 provided at the second point of the swingable arm 69 to be pressed against the driving force input element 66, so that the planet gear 70 is brought into mesh with the driving force input element 66. Furthermore, the pressing force exerted by the planet gear 70 on the driving force input element 66 causes the pressure arm 63 to swing and causes the pressure roller 42 to be pressed against the heating roller 41.

The next topic brought up for discussion with reference to FIG. 5 will be directed to the arrangements of the gears 67, 68, 70 and 66, particularly how the gears 67, 68, 70 and 66 are kept in mesh as the pressure arm 63 swings while a driving force is being transmitted from the output gear 67 to the driving force input element 66. In the drawings to which reference will be made, FIG. 5A is a side view of a fixing device in which a pressure roller is pressed against a heating roller with a predetermined nip width measured between the rollers; and FIG. 5B is a side view of the fixing device in which the pressure arm has swung down. FIGS. 5A and 5B, as in FIGS. 3A and 3B, illustrate a state in which the pressure roller 42 is deformed to a predetermined extent and a state in which the pressure roller 42 is very little deformed, respectively, in order to show the swinging motion of the pressure arm 63 with some exaggeration.

As shown in FIG. 5A, in normal operation, the pressure roller 42 is pressed against the heating roller 41 so as to achieve a predetermined range of nip width N, and adjacent ones of the gears 67, 68, 70 and 66 are in mesh with each other. The driving force transmitted from a driving source (not shown) through a plurality of gears to the output gear 67 is transmitted through the input gear 68, the planet gear 70, and the driving force input element 66, to the pressure roller 42. The rotation of the pressure roller 42 causes the heating roller 41 to rotate, and a developed image of toner, which has been transferred to a sheet 3, is fixed well on the sheet 3, while the sheet 3 is being conveyed through between the two rollers 41, 42.

It is to be noted that the pressure roller 42 is formed with soft rubber provided at its outermost layer and thus with precision in its external-diameter dimension (i.e., its roundness in cross section) lower than that of the heating roller 41. Therefore, in the normal operation as mentioned above, the pressure arm 63 may shift (swing) downwardly as shown in FIG. 5B, due to insufficient roundness (imprecisely shaped surface) of the pressure roller 42. Even if this is the case, the position of the input gear 68 would never shift relative to the fixing device 18', and thus relative to the body casing 2; accordingly, the input gear 68 would never come off the output gear 67 out of mesh.

Furthermore, when the pressure arm 63 swings downwardly and causes the driving force input element 66 to move downward, the planet gear 70 thus pressed downward is moved around the input gear 68 while keeping in mesh with the input gear 68 and the driving force input element 66. Accordingly, distances between axes of adjacent ones of gears 67, 68, 70 and 66 are kept constant, and thus the adjacent ones of gears 67, 68, 70 and 66 would never come out of mesh. Consequently, even when the pressure arm 63 swings downwardly, the driving force from the output gear 67 is transmitted through the input gear 68, planet gear 70 and driving force input element 66, to the pressure roller 42 without fail.

Assuming that the pressure roller 42 were rotatably supported by the frame 62 so that the rotation axis of the pressure roller 42 is fixed relative to the frame 62 (i.e., relative to the rotation axis of the heating roller 41), the possible variations in external diameter of the pressure roller 42 due to its low dimensional precision would not be able to be accommodated, and cause the contact area (nip width) between the heating roller 41 and the pressure roller 42 to vary. Resultantly, a feeding force applied to the sheet between the heating roller 41 and the pressure roller 42 would vary, which would possibly form wrinkles in the sheet.

In contrast, according to the present embodiment, the pressure arm 63 swingable up and down is provided, so that the pressure roller 42 is moved toward and away from the heating roller 41, and thus the variations of the feeding force as mentioned above can be suppressed. As a result, wrinkles which would be formed in the sheet can be prevented.

With the second embodiment, the following advantageous effects can be exerted.

Regardless of the swinging motion of the pressure arm 63, the distances between axes of adjacent ones of gears 67, 68, 70 and 66 can be maintained constant at all times. Therefore, the gears 67, 68, 70 and 66 are kept in constant mesh, and thus good transmission of the driving force to the pressure roller 42 can be ensured.

The present invention is not limited to the second embodiment described above, but can rather be implemented in various alternative forms, as will be demonstrated below.

Although the second embodiment adopts the extension spring S' as a gear biasing mechanism by way of example, the present invention is not limited thereto; for example, a compression spring or a torsion spring may be used, instead or in combination.

Moreover, in the second embodiment, the planet gear 70 is directly in mesh (connected) with the driving force input element 66, but alternatively the planet gear 70 may be connected indirectly, i.e., through one or more of gears rotatably supported by the pressure arm 63, with the driving force input element 66.

Moreover, in the second embodiment the planet gear 70 is directly in mesh (connected) with the input gear 68, but alternatively the planet gear 70 may be connected indirectly, i.e., through one or more gears rotatably supported by the swingable arm 69, with the input gear 68.

Third Embodiment

Figure 7A:
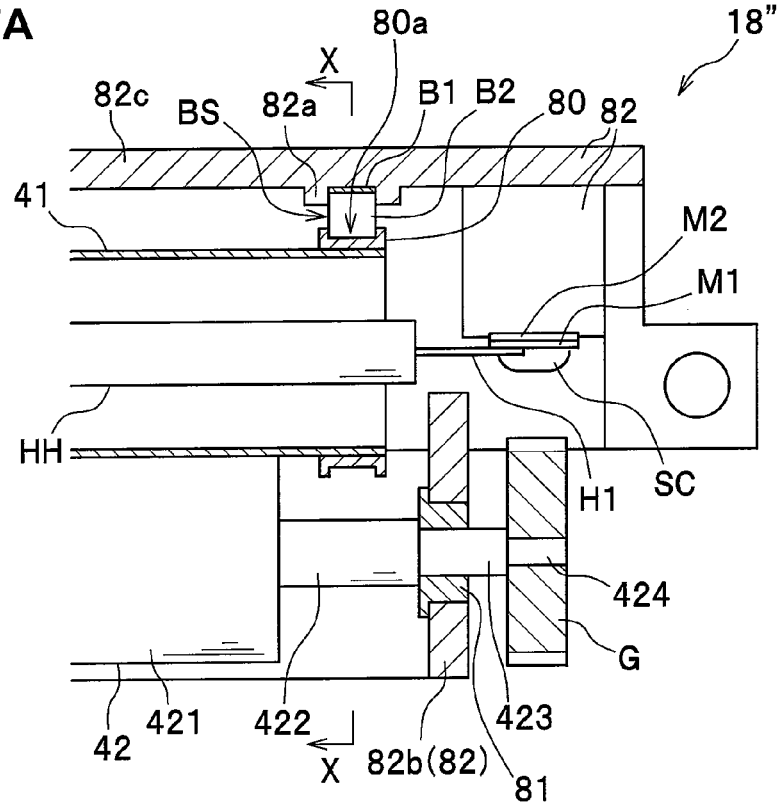
FIG. 7A is a section showing arrangement of components of a fixing device according to a third exemplary embodiment.
Figure 7B:
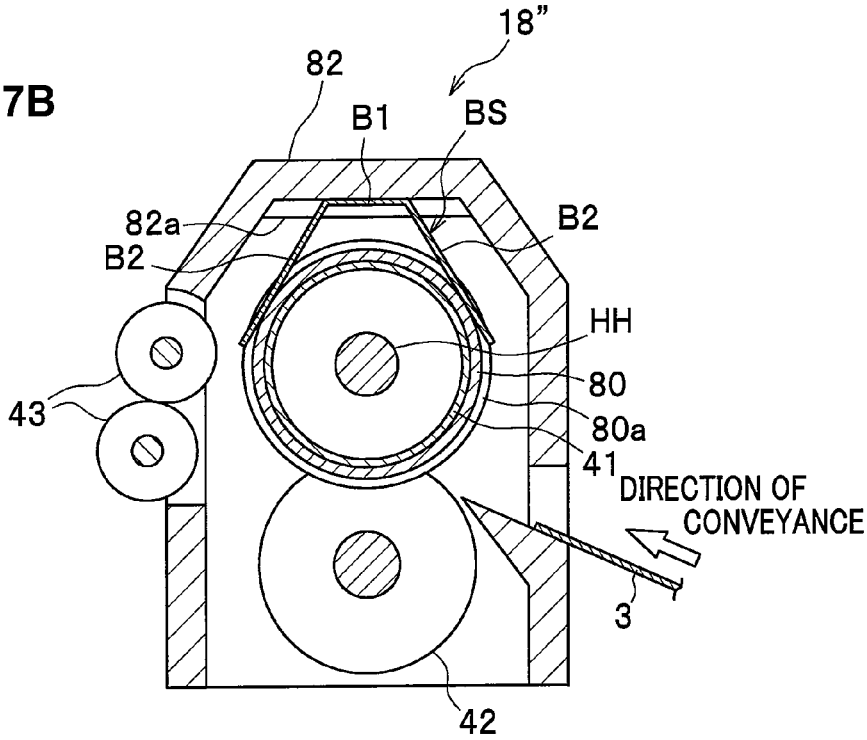
FIG. 7B is a section taken along line X-X of FIG. 7A.
Figure 8:
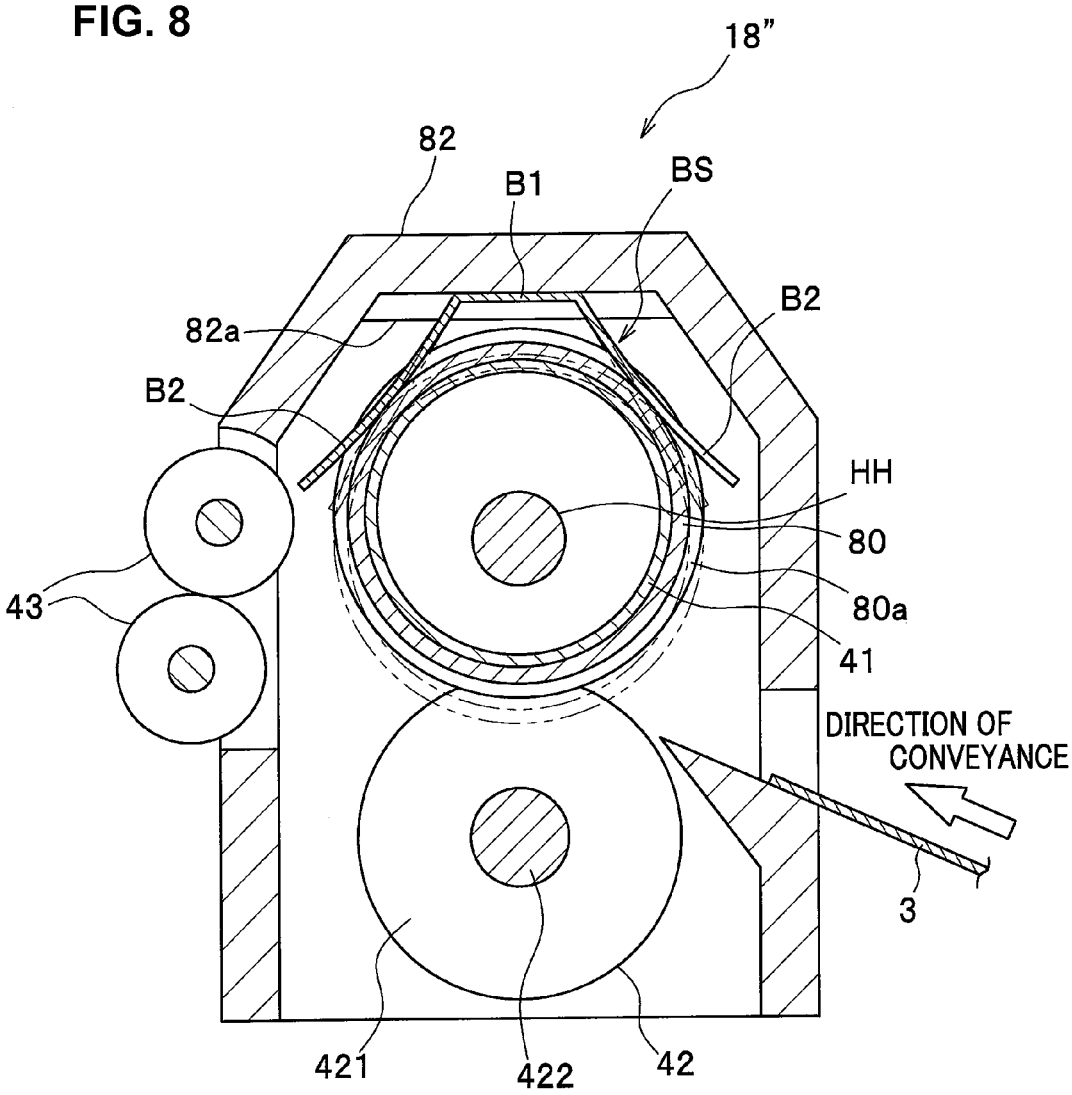
FIG. 8 is a section showing a heating roller having moved away from a pressure roller.

Next, a third embodiment of the present invention will be described in detail with reference made to the drawings where appropriate. In the drawings, to which reference will be made, FIG. 7A is a section showing arrangement of components of a fixing device according to a third exemplary embodiment; FIG. 7B is a section taken along line X-X of FIG. 7A; and FIG. 8 is a section showing a heating roller having moved away from a pressure roller.

As shown in FIGS. 7A and 7B, the fixing device 18" includes a heating roller bearing unit 80, a leaf spring BS, a halogen heater HH, a pressure roller bearing unit 81 and a frame 82, in addition to its principal components (i.e., heating roller 41 and pressure roller 42) described above.

The heating roller 41 is a cylindrical member having a hollow in which a halogen heater HH is installed, so that the heating roller 41 can be heated by the halogen heater HH. The heating roller 41 is rotatably supported at each end thereof by the heating roller bearing unit 80. The heating roller 41 may be of 25 mm in diameter as shown in FIG. 6A. The heating roller 41 may be made of aluminum, and/or may have a surface coated with Teflon (registered trademark, polytetrafluoroethylene or PTFE).

The heating roller bearing unit 80 is a cylindrical member made of plastic, and on its outer cylindrical surface is formed a channel 80*a* having a predetermined width in which the leaf spring BS can be fitted. The heating roller bearing unit 80 is pressed by the leaf spring BS toward the pressure roller 42, and is held between the leaf spring BS and the pressure roller 42. The heating roller bearing unit 80 may be of a conductive or nonconductive (insulating) plastic, and may include ball bearings. The heating roller bearing unit 80 is provided on an annular zone (extending in an axially inside position) at each end of the outer cylindrical surface of the heating roller 41.

The leaf spring BS in this embodiment is made of a single oblong plate bent at two sections toward the same side at the same obtuse angle, symmetrically with respect to a plane perpendicular to the lengthwise direction of the plate. To be more specific, the leaf spring BS includes a base wall portion B1 and a pair of arm portions B2 extending at an angle from both ends of the base wall portion B1 such that the arm portions B2 gradually becomes farther apart from each other toward the ends. The base wall portion B1 of the leaf spring BS is disposed in a spring support portion 82*a* of the frame 82, which will be described later, and the arm portions B2 extend each along a corresponding tangent to the cylindrical surface of the heating roller 41. The leaf spring BS configured to hold the heating roller bearing unit 80 between the arm portions B2. Specifically, each arm portion B2 of the leaf spring BS supports the bottom of the channel 80*a* of the heating roller bearing unit 80.

The pair of arm portions B2 is configured to be slightly unfolded (but still not unfolded to its maximum) when the leaf spring BS is installed together with the heating roller 41 and other components in the frame 82 (as shown in FIGS. 7A and 7B), with some stress applied thereto in contrast to the state before installation where no stress applied thereto. In other words, the leaf spring BS is adaptively arranged in the fixing device 18" under two-way deformable conditions such that the pair of arm portions B2 can become displaced toward a broader position where it is unfolded more or toward a closer position where it is unfolded less. Therefore, as shown in FIG. 8, in the fixing device 18" after completely assembled, the heating roller 41 is not only constantly pressed against the pressure roller 42 by the leaf spring BS, but also movable toward and away from the pressure roller 42. Furthermore, the heating roller 41 is held by the pair of arm portions B2 with a pressing force applied thereto equally with respect to the direction of conveyance of the sheet 3 (the direction of nip width; the direction of a common tangent between the heating roller 41 and the pressure roller 42), and thus movement of the heating roller 41 along the direction of conveyance of the sheet 3 is restricted.

The halogen heater HH is located within the heating roller 41 and fixed at both ends thereof to the frame 8. To be more specific, an electric terminal H1 which projects outwards from each end of the halogen heater HH is welded to a metal sheet M1, and the metal sheet M1 is in turn fixed, by a screw SC made of metal, to a housing-side metal sheet M2 which is formed integrally with a frame 82 made of plastic, so that the halogen heater HH is fixed relative to the frame 82. Accordingly, even when the heating roller 41 is shifted as shown in FIG. 8 due to variations of the external diameter of the pressure roller 42, the halogen heater HH is unaffected by the shifting of the heating roller 41, and remains fixed relative to the frame 82. The halogen heater HH is supplied with electric power from an external power source (not shown), such as an on-board power module, an electrical outlet of commercial power, etc., through the housing-side metal sheet M2, the metal sheet M1 and the electric terminal H1, so as to produce heat.

The pressure roller 42 includes a body 421 having a cylindrical shape, and a rotation shaft 422 of which a middle portion is disposed inside and coaxially with the cylindrical body 421 and two end portions protrude from two ends of the cylindrical body 421, respectively. Each end portion of the rotation shaft 422 includes a middle-diameter portion 423 having a smaller diameter than the middle portion of the rotation shaft 422, and a small-diameter portion 424 having a smaller diameter than the middle-diameter portion 423, which are arranged in such a manner that the rotation shaft 422 has its diameters reduced stepwise toward each end thereof. The middle-diameter portion 423 is rotatably supported by the pressure roller bearing unit 81. The driving force input element G is fixed to the small-diameter portion 424. Accordingly, upon transmission of a driving force from a driving device (not shown) to the driving force input element G, the pressure roller 42 is caused to rotate.

The rotation shaft 422 is designed to have a lengthwise dimension such that each of the end portions thereof, i.e., middle-diameter portion 423 and small-diameter portion 424, is in an axially outside position of a cylindrical body of the heating roller 41. Therefore, a bearing support portion 82*b* of the frame 82 for supporting the pressure roller bearing unit 81 can be designed in appropriate dimensions and provided in an appropriate position, and the driving force input element G can be designed in greater dimensions.

The pressure roller 42 may be of 25 mm in diameter, for example, as shown in FIG. 6B. The pressure roller 42 may have a bar-like metal core provided in the center, a polyurethane rubber layer of 6-7 mm in thickness provided around a cylindrical surface of the core, and a tube made of Teflon (registered trademark, PTFE) of 20-50 μm in thickness fitted on an outer surface of the polyurethane rubber layer. The polyurethane rubber layer makes the pressure roller 42 resiliently deformable. The polyurethane material used therefor may be foamed to make the layer more easily deformable, so that a nip width can be made greater. With an embodiment in which the pressure roller 42 is made of a soft material as described above, the precision in external-diameter dimension (roundness in cross section) of the pressure roller 42 is likely to become low, and thus the above-described embodiment configured to absorb the variations in the external diameter by the reciprocating motion of the heating roller 41 can most effectively bring about its advantages.

A diameter Dp of the pressure roller 42 and a nip width (contact width) N between the heating roller 41 and the pressure roller 42 in circumferential directions thereof are, as in the first embodiment (see FIG. 2C), configured to have a relationship represented by the following expression (1):

$$0.24<N/Dp<0.6 \quad (1)$$

where the nip width N is a length of a curve formed on a plane perpendicular to the rotation axis of the pressure roller 42 along the surface of a recessed portion of the pressure roller 42 which is produced when the pressure roller 42 is pressed against the heating roller 41 (or a length of an arc formed on a plane perpendicular to the rotation axis of the heating roller 41 along a surface in contact with the recessed portion of the pressure roller 42).

The nip width N may be measured, for example, by a method of utilizing a sheet of paper one side of which is solidly painted in black all over its surface (such a sheet will hereinafter referred to as "black sheet"), as follows. Specifically, in this method, a black sheet is held between the heating roller 41 and the pressure roller 42 for a predetermined period of time, and then removed therefrom for observation. An area (strip) of the black sheet held by the two rollers 41, 42 should become glossier than the other areas. The width of the glossier strip is measured by vernier calipers, or the like, to thereby measure the nip width N.

The diameter Dp of the pressure roller 42 and a diameter Dh of the heating roller 41 are configured to have a relationship represented by the following expression (2):

$$Dp/2<Dh<2Dp \quad (2)$$

The frame 82 is formed in a container-like shape having an opening which opens toward downward, and mainly contains the heating roller 41 and the pressure roller 42. The spring support portion 82*a* described above is provided in pair on an upper wall 82*c* of the frame 82, such that each spring support portion 82*a* projects downward. The spring support portions 82*a* are located a predetermined distance (corresponding to the width of the base wall portion B1) apart from each other in the axial directions of the heating roller 41 and opposite each other. With this structure, the base wall portion B1 of the leaf spring BS is held from the axial directions of the heating roller 41 by the spring support portions 82*a* so that the movement of the leaf spring BS in the axial directions is restricted.

The width of the leaf spring BS is designed to be substantially equal to the width of a channel 80*a* of the heating roller bearing unit 80, and thus the movement of the heating roller bearing unit 80 in the axial directions is restricted by the leaf spring BS. Since the heating roller 41 and the heating roller bearing unit 80 are normally engaged with each other with a relative movement in the axial directions restricted, the restriction placed on the movement of the heating roller bearing unit 80 by the leaf spring BS results in restriction on the movement of the heating roller 41.

With the third embodiment, the following advantageous effects can be exerted.

Since N/Dp is greater than 0.24, the nip width N can be made so great as could be achieved to the limit placed by the size (diameter) of the pressure roller 42. Accordingly, the time and area of contact between the sheet 3 and the heating roller 41 when the sheet 3 passes between the two rollers 41 and 42 can be increased, so that the heating roller 41 can be rendered operable at lower temperatures and/or at higher speeds. Moreover, since N/Dp<0.6, the excessive increase in the nip width which would increase the driving torque of the pressure roller 42 can be suppressed, and thus the overload on the fixing device can be avoided. This feature of N/Dp<0.6 in this embodiment also serve to suppress excessive load on the sheet 3 passing between the pressure roller 42 and the heating roller 41.

Incidentally, the nip width N which satisfies the expression (1), if applied to a fixing device of 'heating roller driving' type, would cause the heating roller to slip on the sheet being conveyed by the pressure roller. Therefore, the present embodiment can realize a fixing device with a heating roller operable at lower temperatures and/or at higher speeds which would be impossible due to a likelihood of a slip in the 'heating roller driving' scheme.

Furthermore, the feature of N/Dp being less than 0.6 serves to prevent excessive increase in the nip width, thus reducing the torque applied to the pressure roller 42 when the pressure roller is caused to rotate, to thereby improve the durability of the fixing device 18". Prevention of excessive increase in the nip width also serves to reduce the load placed on the sheet 3 passing through the heating roller 41 and the pressure roller 42.

Since the diameter Dp of the pressure roller 42 and the diameter Dh of the heating roller 41 have a relationship represented by the expression (2): Dp/2<Dh<2Dp, the nip width N between the rollers 41 and 42 can be made as great as possible. Moreover, the dimensions of the rollers 41 and 42 are well balanced, and thus the space around the rollers 41, 42 can be utilized effectively.

Since the halogen heater HH is fixed relative to the frame 82 while the heating roller 41 is configured to reciprocate independently of the halogen heater HH, damage to the electric system of the halogen heater HH (e.g., construction around electric terminal H1) can be prevented.

The heating roller 41 allowed to reciprocate mainly by the leaf spring BS alone can be achieved in a smaller number of parts, and thus at a lower cost in comparison, for example, with a configuration in which a pressure roller is pressed against a heating roller by a spring-biased arm.

The pair of arm portions B2 of the leaf spring BS configured to hold the heating roller bearing unit 80 serves to restrict the movement of the heating roller 41 in the direction of conveyance of the sheet 3.

Since the driving force input element G is disposed in an axially outside position of the cylindrical body of the heating roller 41, the driving force input element G may be rendered greater in diameter, so that the torque applied to the driving force input element G can be reduced.

The present invention is not limited to the third embodiment described above, but can rather be implemented in various alternative forms, as will be demonstrated below.

Although the third embodiment adopts the leaf spring BS as a pressing device with an elastic member by way of example, the present invention is not limited thereto; for example, an arm member configured to support a heating roller in a manner that permits the heating roller to rotate and rotatably supported by a frame, in combination with a spring member configured to bias the arm member to press the heating roller against the pressure roller, may be used, instead. Moreover, the elastic member for use in the pressing device may, for example, be a leaf spring curved in an arcuate shape, a coil spring, a torsion spring, etc., instead of the bent leaf spring BS.

It is contemplated that various modifications and changes may be made to the exemplary embodiments of the invention without departing from the spirit and scope of the embodiments of the present invention as defined in the following claims.

In the exemplary embodiments described above, the present invention is applied to a laser printer 1, but the present invention is not limited thereto, but may be applied, for example, to a copier, an all-in-one printer, and other image-forming apparatuses.

In the exemplary embodiments described above, the transfer roller 30 is employed as an example of a transfer unit configured to come in contact with a photoconductor drum, but the present invention is not limited thereto; for example, a non-contact type transfer unit may be employed, instead, which is configured to transfer a developed image of toner from the photoconductor drum to a sheet.

The sheet 3 of paper, such as thick paper (a cardboard), a postcard, thin paper (a flimsy), etc. is used as an example of a recording sheet in the above-exemplified embodiments, but the present invention is not limited thereto; for example, an OHP sheet, etc. may be used, instead.

The halogen heater HH is employed as an example of a heat source in the above-exemplified embodiments, but the present invention is not limited thereto; for example, an induction heating (IH) heater, resistance heater, etc. may be employed, instead.

It is to be understood that the term 'toner' used in describing the exemplary embodiments above encompasses any kinds of developer without any limitation on their material or components. Similarly, the developer cartridge 28 as an example of a developer unit configured to supply toner onto the photoconductor, the scanner unit 16 as an example of an exposure apparatus configured to receive a signal of the image and cause a laser beam to scan in accordance with the signal of the image, the photoconductor drum 27 as an example of a photoconductor configured to be scanned by the laser beam from the exposure apparatus to form an electrostatic latent image thereon, are all described in the above embodiments for illustration purposes only, and the present invention is not limited their specific constructions.

In the first and second embodiments, the first point (first axis) of the pressure arm 63 which is supported by the frame 62 in a manner that permits the pressure arm 63 to swing on the first axis is located near one end of the pressure arm 63, and the second point (second axis) of the pressure arm 63 at which the pressure arm 63 is configured to support the pressure roller 42 in a manner that permits the pressure roller 42 to rotate on the second axis is located at an appropriated position that is closer to the other end of the pressure arm 63 than the first point and separate from the first point at a predetermined distance. Thus, the present invention is not limited to the particular embodiments as illustrated in FIGS. 2A-5B; rather, any configuration may be possible as long as the pressure arm has a first axis and a second axis which are located in different positions. For example, the pressure arm may be swingably supported, at the first axis located at some midpoint of the oblong members of the pressure arm, by the frame, while the pressure arm may be configured to support the pressure roller at the second axis located at one ends of the oblong members of the pressure arm.

The nip width N may be any value as long as the expression (1) $0.24<N/Dp<0.6$ is satisfied. Preferably but not necessarily, the nip width N may be 6 mm or greater, in that this specific range has been found out practically conformable to actual circumstances (i.e., in terms of the diameter of the pressure roller 42 and/or the size of the sheet 3). In consideration of the relationship between the rollers 41 and 42 as shown in FIGS. 6A and 6B, the nip width N may preferably but not necessarily be on the order of 6 to 10 mm.

Furthermore, the diameter of the pressure roller 42 may preferably but not necessarily be as large as illustrated in FIG. 6B, i.e., on the order of 20 to 40 mm.

Moreover, the dimension in the radial direction of the rubber layer provided in the pressure roller 42 may preferably but not necessarily be as thick as illustrated in FIG. 6B, i.e., on the order of 5 to 15 mm. Furthermore, the thickness of the rubber layer, in the case where the pressure roller 42 has a diameter of 25 mm, may be on the order of 6 to 8 mm, and more preferably, on the order of 7.5 mm.

In order to obtain a desired nip width N by pressing and partially collapsing the pressure roller 42 to a predetermined extent, various parameters, such as a tension of the spring, a hardness of the pressure roller 42, etc., may be adjusted, and it has turned out to be desirable that Asker C hardness of the pressure roller be 37 degrees or less. This makes it possible to increase the nip width N without the need for increasing the spring tension so much, so that the torque for driving the pressure roller 42 can be made smaller.

IMPLEMENTATION EXAMPLES

Some examples of our fixing device implemented according to the above-illustrated embodiments for evaluation will be described below. To be more specific, two experimental results will be shown in which EXAMPLE 1 represents the observations on the relationship between the nip width N and a slip, and EXAMPLE 2 represents the observations on the nip width N and a reflection density decrease rate (toner loss rate).

Example 1

Conditions of the experiment in EXAMPLE 1 were as follows:

(a) Fixing device evaluated: two types ('heating roller driving' type and 'pressure roller driving' type) of fixing device which were installed in a laser printer model HL-5250 manufactured by Brother Industries, Ltd.;
(b) Sheet: A4 size, ordinary paper (grammage: 80 $g/m^2$);
(c) Fixing temperature (surface temperature of the heating roller): 193° C.;
(d) Ambient temperature: ordinary room temperature; and
(e) Diameter Dp of the pressure roller: 25 mm.

The nip width N was changed stepwise under the above conditions, and an experiment was carried out for each nip width N to investigate whether or not a slip occurs between two rollers which hold a sheet. In the experiment, a predetermined driving force is supplied to the heating roller alone in the fixing device of HL5250 laser printer to provide the 'heating roller driving' type fixing device. On the other hand, a predetermined driving force is supplied, contrastively, to the pressure roller alone in the fixing device of the same-model (HL-5250) laser printer to provide the 'pressure roller driving' type fixing device.

These experiments have brought about the results as shown in TABLE 1. In TABLE 1, 'O' denotes a normal (successful) state in which a slip did not occur, while 'X' denotes an abnormal (poor) state in which a slip occurred. In other words, 'O' indicates that one roller successfully followed the other roller supplied with a driving force, while 'X' indicates that one roller failed to follow the other roller supplied with a driving force. '–' indicates that no test printing operation was carried out.

To be more specific, 'O' indicates that 1,000 test printing operations were all completely successful without a slip, while 'X' denotes that a slip was observed during 1,000 test printing operations. Determination as to whether a slip had occurred was made by a skilled engineer observing an image printed on a sheet; it was thus determined that a slip had occurred if a disturbance in the printed image was observed.

TABLE 1

| Pressure Roller Diameter Dp [mm] | 25 | | | | | |
|---|---|---|---|---|---|---|
| Nip width N [mm] | 5.0 | 6.0 | 6.3 | 6.8 | 7.3 | 8.0 |
| N/Dp | 0.20 | 0.24 | 0.25 | 0.27 | 0.29 | 0.32 |
| Heating roller driving scheme | ○ | X | X | X | X | X |
| Pressure roller driving scheme | — | ○ | ○ | ○ | ○ | ○ |

The results of EXAMPLE 1, as shown in TABLE 1, demonstrate that the 'heating roller driving' scheme would cause a slip to occur when N/Dp is 0.24 and thus cannot increase the nip width N any more.

Example 2

Conditions of the experiment in EXAMPLE 2 were as follows:

(f) Fixing device evaluated: fixing device ('pressure roller driving' type only) which were installed in a laser printer model HL-5250 manufactured by Brother Industries, Ltd.;

(g) Sheet conveyance speed: 28 ppm (page per minute);

(h) Sheet: A4 size, ordinary paper (grammage: 80 g/m$^2$);

(i) Fixing temperature (surface temperature of the heating roller): 193° C.;

(j) Ambient temperature: 10° C.;

(k) Humidity: 10%;

(l) Reflection densitometer: D19C densitometer from GretagMacbeth was used for densitometric measurement;

(m) Reflection density measurement: reflection density was measured under two densitometric conditions as:

Condition 1: density of a developed image fixed on a sheet was measured as it was; and Condition 2: a developed image formed on a sheet (whose density was measure under condition 1) was rubbed with a cloth for a predetermined period of time with a predetermined pressure (as in the friction fastness test), and thereafter underwent densitometric measurement; and (n) Reflection density decrease rate:

$$100\times(RD1-RD2)/RD1$$

where RD1 is a reflection density measured under Condition 1, and RD2 is a reflection density measured under Condition 2.

The nip width N was changed stepwise under the above conditions, and an experiment was carried out for each nip width N to investigate how the reflection density decrease rate, which indicates how much the toner has been lost, is affected by the nip width N. Hereupon, the reflection density decrease rate refers to a numerical value which is measured after the toner on the sheet is dried and which indicates how much the toner has been lost. The lower value in reflection density decrease rate exhibits the superiority in fixability performance of the fixing device. In this experiment, the data for 5.0 mm of the nip width N were obtained by means of a 'heating roller driving' type fixing device, and the other data were obtained by means of a 'pressure roller driving' type fixing device. It is however to be understood that the same results would be obtained even if all the data were obtained by means of a 'pressure roller driving' type fixing device in this experiment.

Figure 9:
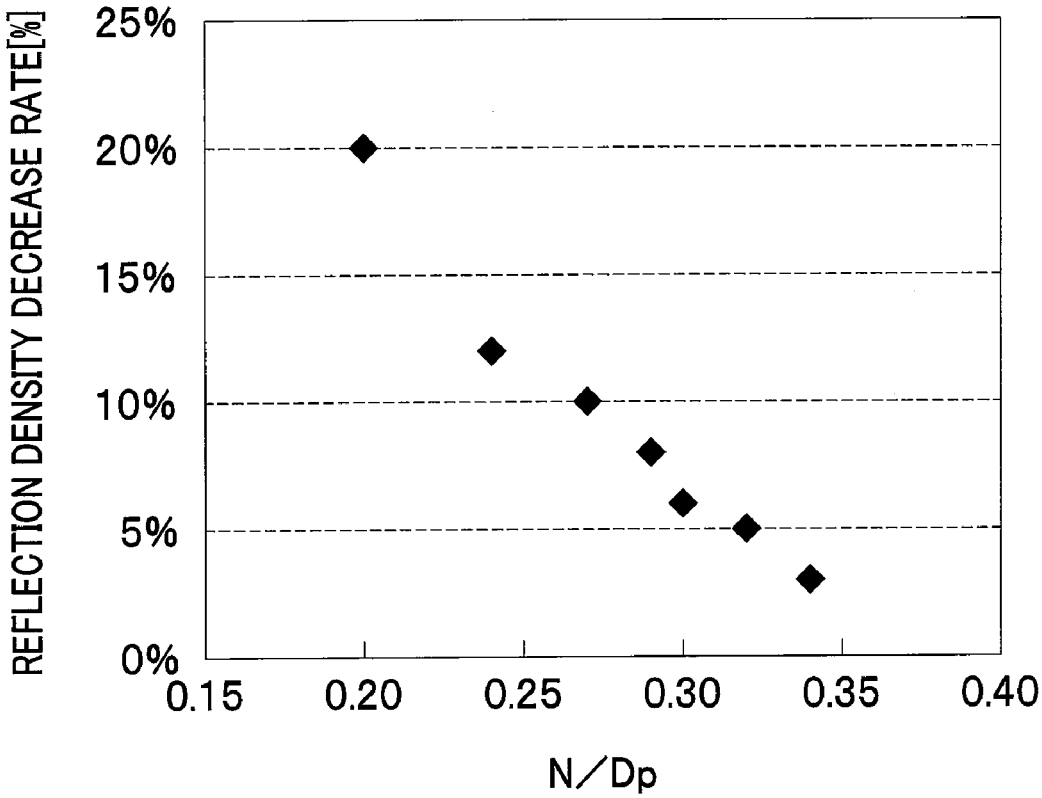
FIG. 9 is a graph showing a relationship between N/Dp and a reflection density decrease rate.

These experiments have brought about the results as shown in TABLE 2, see below, and FIG. 9.

TABLE 2

| Pressure Roller Diameter Dp [mm] | 25 | | | | | | |
|---|---|---|---|---|---|---|---|
| Nip width N [mm] | 5.0 | 6.0 | 6.8 | 7.2 | 7.4 | 8.0 | 8.4 |
| N/Dp | 0.20 | 0.24 | 0.27 | 0.29 | 0.30 | 0.32 | 0.34 |
| Reflection density decrease rate [Average; %] | 20 | 12 | 10 | 8 | 6 | 5 | 3 |

It has been shown in EXAMPLE 2 that N/Dp>0.24 is preferable. Consequently, the experimental observations given in EXAMPLE 1 and EXAMPLE 2 have established that N/Dp>0.24 is preferable.

What is claimed is:

1. A fixing device for fixing a developed image, the fixing device provided in an image-forming apparatus having a photoconductor and a developer unit, the fixing device comprising:

a heating roller configured to be heated by a heat source;

a pressure roller disposed adjacent to the heating roller, such that a recording sheet is fed and conveyed between the pressure roller and the heating roller;

a driving force input element fixed to the pressure roller and configured to cause the pressure roller to rotate;

a frame configured to support the heating roller in a manner that permits the heating roller to rotate;

a pressure arm having a first axis and a second axis, wherein the pressure arm is supported by the frame in a manner that permits the pressure arm to swing on the first axis fixed relative to the frame, and the pressure arm is configured to support the pressure roller at the second axis in a manner that permits the pressure roller to rotate on the second axis;

an input gear rotatably supported by the frame, and configured to mesh with an output gear rotatably provided in a body of the image-forming apparatus;

a swingable arm configured to swing on an axis coincident with a rotation axis of the input gear;

a planet gear connected with the input gear and the driving force input element, and rotatably supported by the swingable arm; and a gear biasing mechanism configured to cause the swingable arm to bias the planet gear toward the driving force input element, wherein a diameter Dp of the pressure roller and a nip width N between the heating roller and the pressure roller in circumferential directions thereof have a relationship represented by the following expression:

$$0.24<N/Dp<0.6.$$

2. The fixing device according to claim 1, wherein the planet gear and the input gear are connected directly with each other, and the planet gear and the driving force input element are connected directly with each other.

3. An apparatus for forming an image on a recording sheet, comprising:

an exposure apparatus configured to receive a signal of the image and cause a laser beam to scan in accordance with the signal of the image;

a photoconductor configured to be scanned by the laser beam from the exposure apparatus to form an electrostatic latent image thereon;

a developer unit configured to supply developer onto the photoconductor;

a transfer unit configured to transfer a developed image of developer from the photoconductor to the recording sheet;

an output gear;

a fixing device for fixing a developed image, the fixing device comprising:

a heating roller configured to be heated by a heat source;

a pressure roller disposed adjacent to the heating roller, such that a recording sheet is fed and conveyed between the pressure roller and the heating roller;

a driving force input element fixed to the pressure roller and configured to cause the pressure roller to rotate;

a frame configured to support the heating roller in a manner that permits the heating roller to rotate;

a pressure arm having a first axis and a second axis, wherein the pressure arm is supported by the frame in a manner that permits the pressure arm to swing on the first axis fixed relative to the frame, and the pressure arm is configured to support the pressure roller at the second axis in a manner that permits the pressure roller to rotate on the second axis;

an input gear rotatably supported by the frame, and configured to mesh with the output gear rotatably provided in a body of the image-forming apparatus;

a swingable arm configured to swing on an axis coincident with a rotation axis of the input gear;

a planet gear connected with the input gear and the driving force input element, and rotatably supported by the swingable arm; and a gear biasing mechanism configured to cause the swingable arm to bias the planet gear toward the driving force input element, wherein a diameter Dp of the pressure roller and a nip width N between the heating roller and the pressure roller in circumferential directions thereof have a relationship represented by the following expression:

$$0.24<N/Dp<0.6$$

* * * * *